US005673879A

United States Patent [19]

Hsieh

[11] Patent Number: 5,673,879

[45] Date of Patent: Oct. 7, 1997

[54] FOLDAWAY STAND OF A GOLF BAG

[76] Inventor: Chi-Chung Hsieh, 6F-3 No. 67, Sung-Chiang Road, Taipei, Taiwan

[21] Appl. No.: 599,849

[22] Filed: Feb. 12, 1996

[51] Int. Cl.[6] ..... A63B 55/00

[52] U.S. Cl. ..... 248/96; 206/315.7

[58] Field of Search ..... 248/96, 168, 170, 248/171; 206/315.7, 315.3

[56] References Cited

U.S. PATENT DOCUMENTS

| | | | |
|---|---|---|---|
| 5,147,089 | 9/1992 | Anderson | 248/96 |
| 5,152,483 | 10/1992 | Maeng | 248/96 |
| 5,154,377 | 10/1992 | Suk | 206/315.7 X |
| 5,607,128 | 3/1997 | Suk | 248/96 |

*Primary Examiner*—Ramon O. Ramirez

*Attorney, Agent, or Firm*—Morton J. Rosenberg; David I. Klein

[57] ABSTRACT

A foldaway stand which includes two mounting frame fastened to a golf bag on the outside at different elevations, a frame bar detachably connected between the mounting frames, a sliding frame slidably mounted around the frame bar, two legs pivotably connected to the sliding frame at two opposite sides by two connectors, a foot plate, two links connected between connectors and the foot plate and constrained by hooks on the lower mounting frame. The links are forced by the foot plate to push the legs from the collapsed position to the extended position when the golf bag is tilted to force the foot plate against the ground.

2 Claims, 6 Drawing Sheets

FOLDAWAY STAND OF A GOLF BAG

BACKGROUND OF THE INVENTION

The present invention relates to golf bags, and relates more particularly to the foldaway stand of a golf bag.

The structure of the folding golf bag stand of U.S. Pat. No. 5,340,063, which was issued to the present invention on Aug. 23, 1994, comprises two legs (22, 22') pivotably fastened to a golf bag (1) by a mount (2), a link frame (23) having a top end pivotably connected to the legs (22, 22') and a bottom end hooked with a base plate (25) hinged to the bottom (14) of the golf bag (1), a locating strap (26) to confine the included angle between the legs (22, 22'), and a spring (24) supported between the legs (22, 22'). This folding golf bag stand is functional, however when the stand is folded up, the base plate (25) projects out of the bottom (14) of the golf bag (1), causing a destruction to the sense of beauty. Furthermore, because the mount (2) is fastened to the inside of the golf bag (1), the golf bag (1) cannot be collapsed, therefore the golf bag (1) still occupy much storage space.

SUMMARY OF THE INVENTION

The present invention has been accomplished to provide a foldaway stand which eliminates the aforesaid drawbacks. According to one aspect of the present invention, the foldaway stand comprises a first mounting frame fastened to a golf bag on the outside at a higher elevation, the first mounting frame comprising a downward receptacle and a retaining hole at the downward receptacle; a second mounting frame fastened to the golf bag on the outside at a lower elevation, the second mounting frame comprising an upward receptacle, two hooks raised from the upward receptacle at two opposite sides, a compression spring mounted inside the upward receptacle, and a stop plate supported on the compression spring inside the upward receptacle; a frame bar having a top end inserted into the downward receptacle, and a bottom end inserted into the upward receptacle and stopped against the stop plate; a sliding frame moved along the frame bar, the sliding frame comprising a sleeve slidably sleeved onto the frame bar, two round rods raised from the sleeve at two opposite sides, and two locating pins respectively fastened to the round rods; two legs pivotably connected to the round rods of the sliding frame, and turned within a fixed angle relative to the round rods of the sliding frame between the collapsed position closely attached to the golf bag and the extended position to support the golf bag on the ground in a tilted position; two connectors respectively connected between the legs and the round rods of the sliding frame, each connector comprising a top transverse coupling tube revolvably sleeved onto one round rod of the sliding frame, two symmetrical radial grooves disposed inside the top transverse coupling tube and acting with the two opposite ends of the locating pin of the respective round rod to confine the turning angle of the top transverse coupling tube relative to the respective round rod, a bottom end fixedly secured to one leg, and a pivot hole in the middle; a foot plate attached to the second mounting frame at a bottom side, the foot plate comprising two retaining holes; two links respectively made from metal rods, each link having a hooked top end pivotably hooked in the pivot hole of one connector, and a hooked bottom end retained to one hook of the second mounting frame and hooked in one retaining hole of the foot plate to hold the foot plate in place; and a retainer spring fixedly secured to the top end of the frame bar, having a raised portion forced into the retaining hole of the downward receptacle of the first mounting frame. According to another aspect of the present invention, the frame bar can be disconnected from the first mounting frame and the second mounting frame by: forcing the raised portion of the retainer spring inwards from the retaining hole of the downward receptacle of the first mounting frame, and then pulling the frame bar downwards against the stop plate and the compression spring to disengage the top end of the frame bar from the downward receptacle of the first mounting frame.

DETAILED DESCRIPTION OF THE PREFERRED EMBODIMENT

Figure 1:
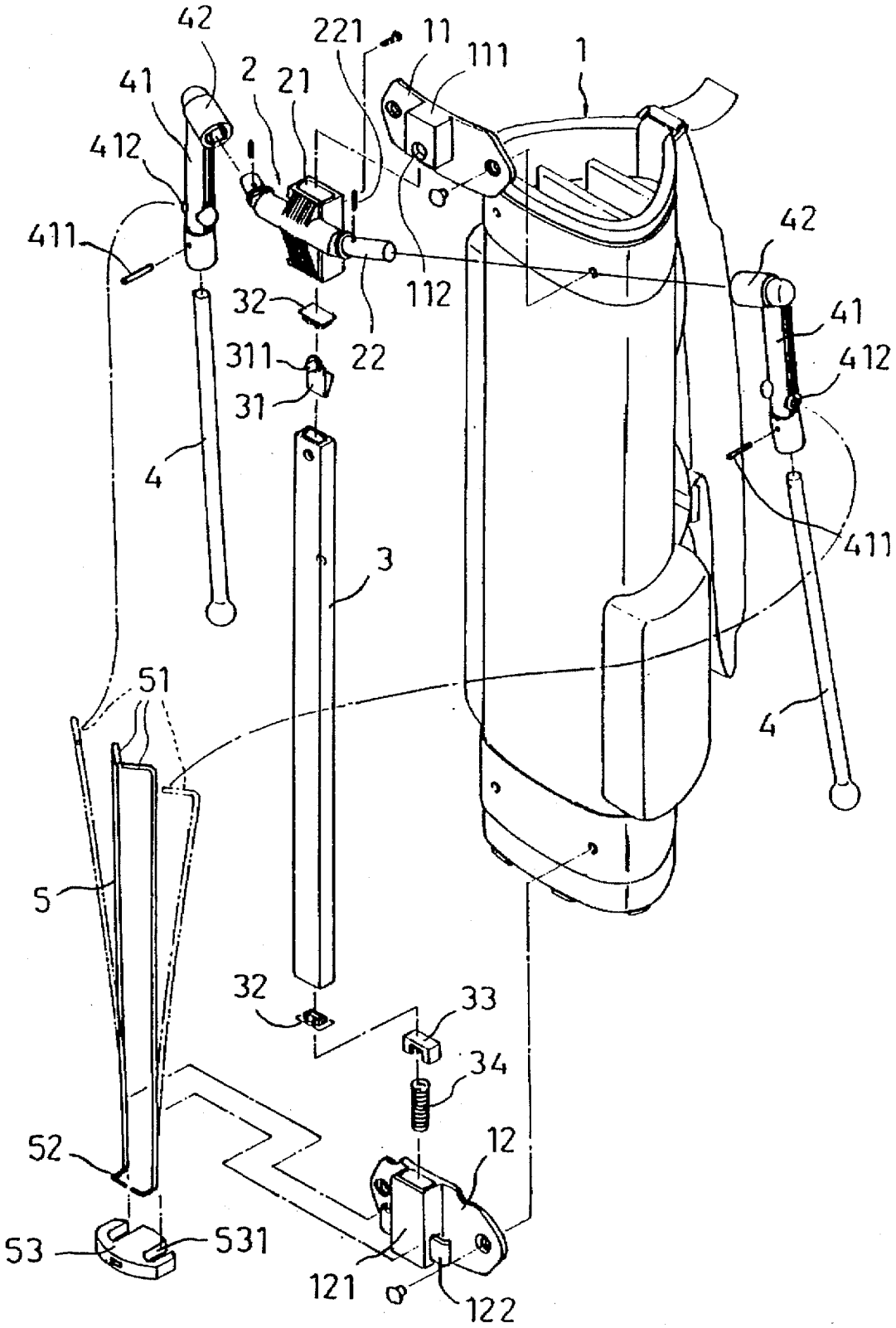
FIG. 1 is an exploded view of the present invention, showing the structure of the foldaway stand thereof.
Figure 2:
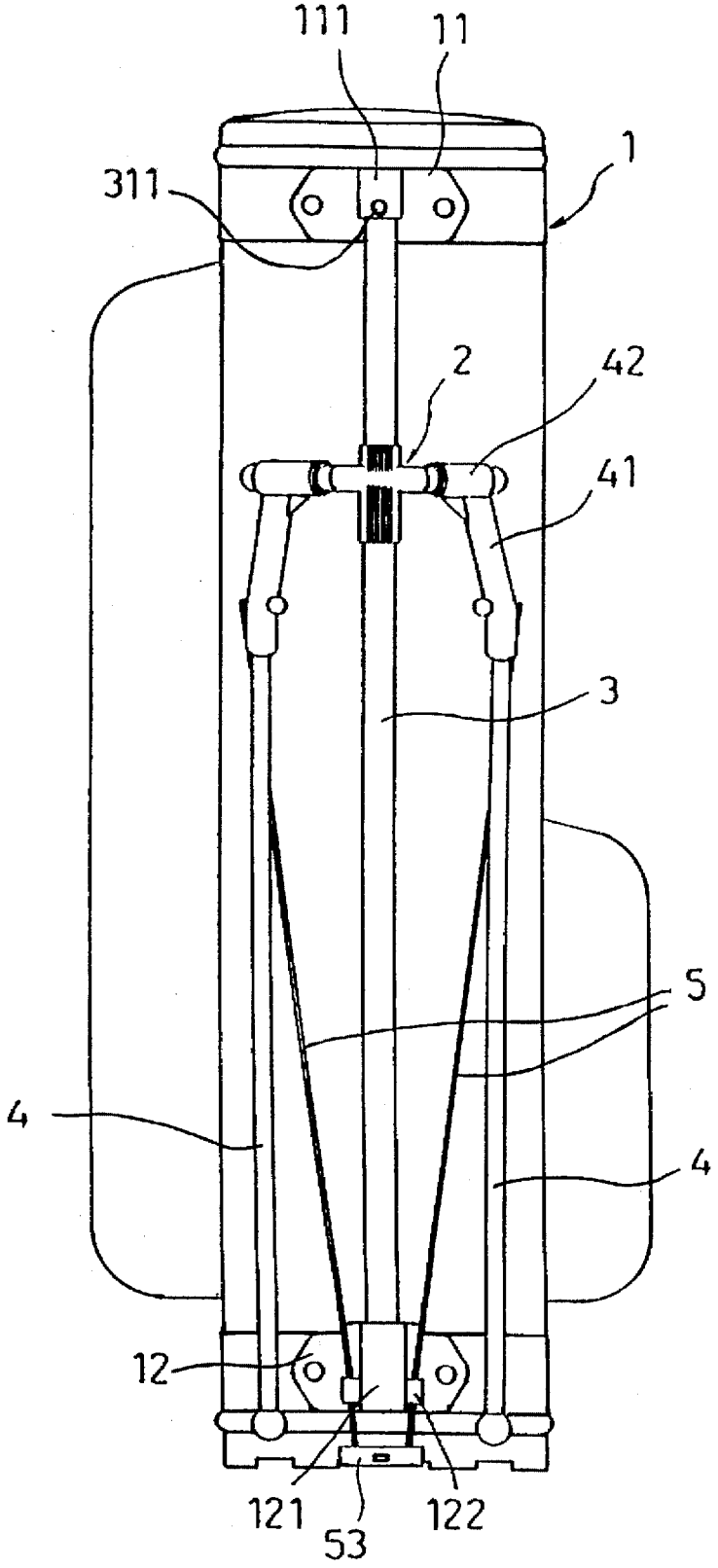
FIG. 2 is a side view of the present invention, showing the foldaway stand fastened to the golf bag at one side and collapsed.
Figure 5:
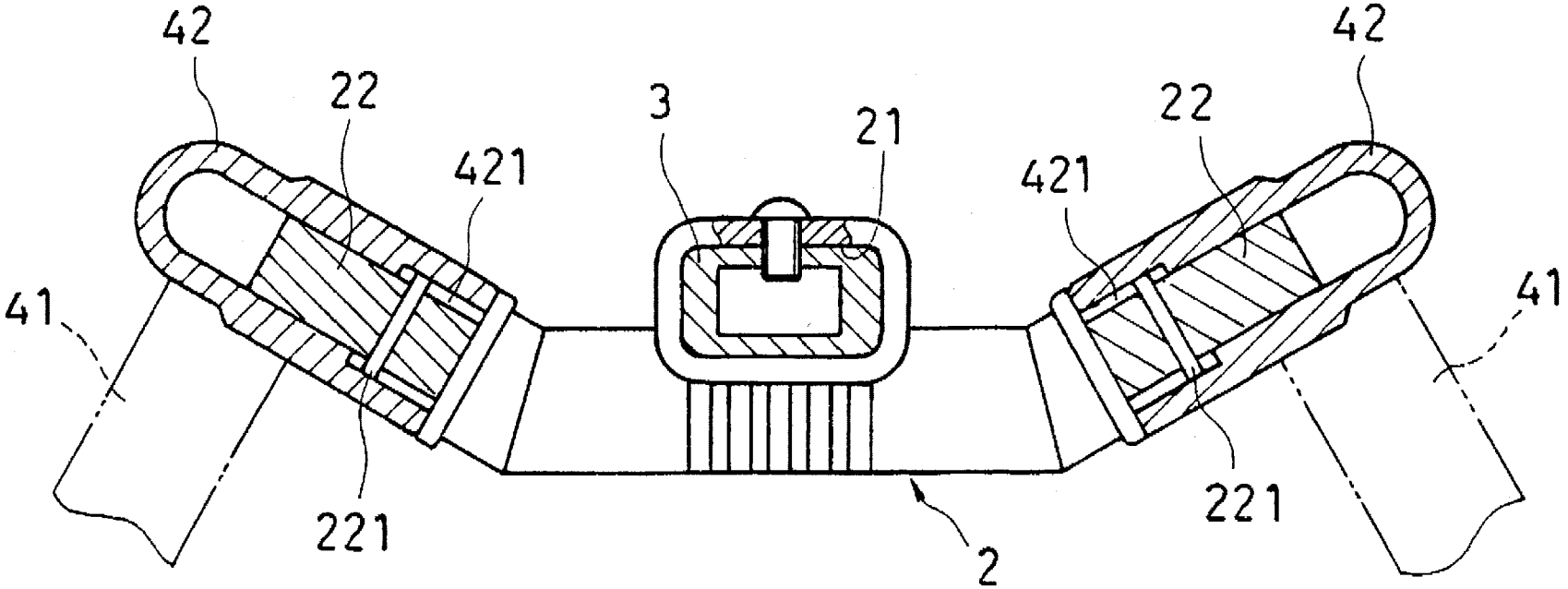
FIG. 5 is a sectional view showing the connection between the round rods of the sliding frame and the connectors according to the present invention.
Figure 6:
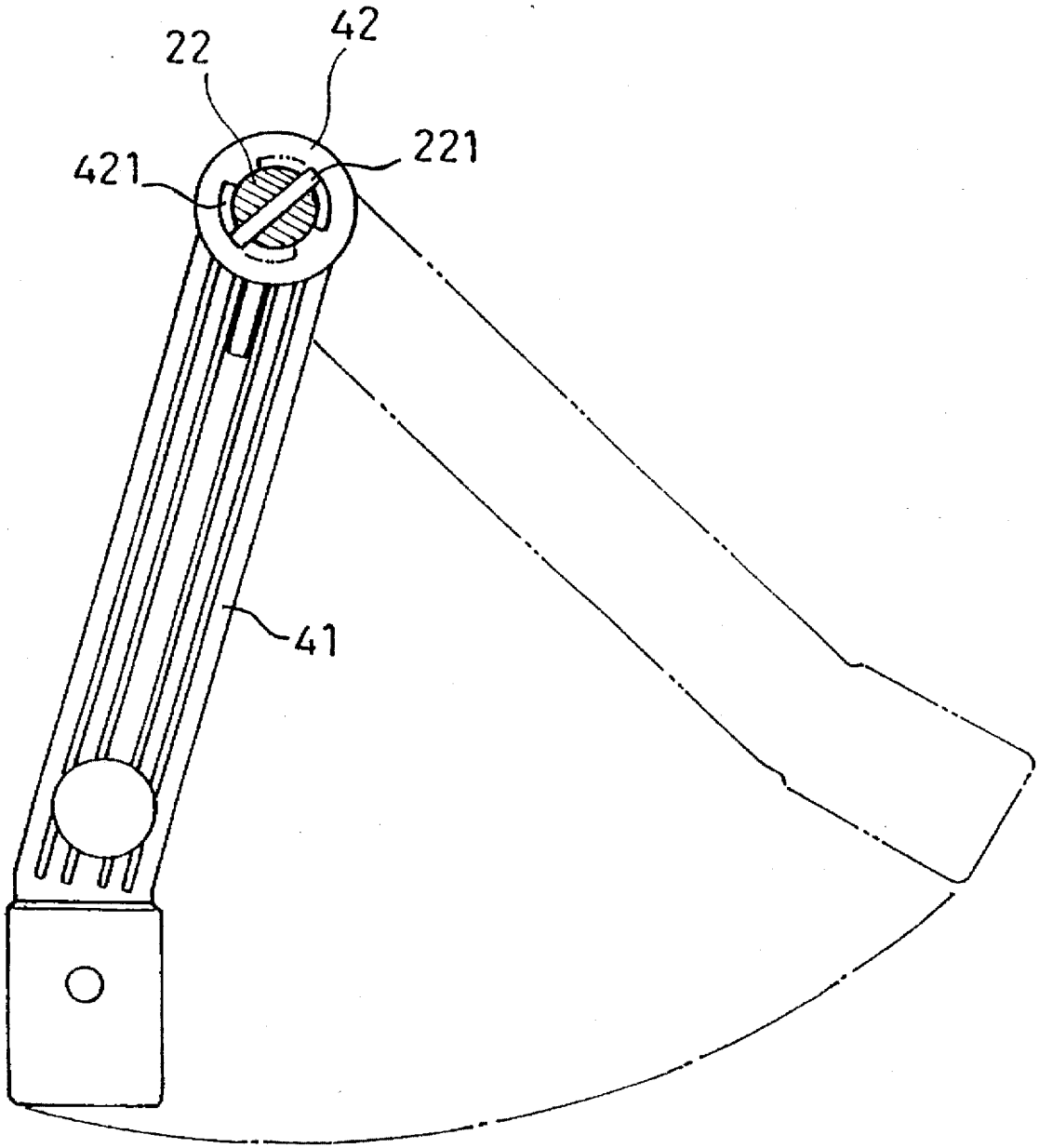
FIG. 6 is a sectional view of the connector, showing the connection between the radial grooves and the locating pin according to the present invention.

Referring to FIGS. 1 and 2, a first mounting frame 11, and a second mounting frame 12 are respectively fastened to the two opposite ends of the golf bag, referenced by 1, on the outside. The first mounting frame 11 comprises a downward receptacle 111, and a retaining hole at the downward receptacle 111. The second mounting frame 12 comprises an upward receptacle 121, two hooks 122 bilaterally raised from the outside wall of the upward receptacle 121, a spring 34 mounted inside the upward receptacle 121, and a stop plate 33 mounted within the upward receptacle 121 and supported on the spring 34. A hollow frame bar 3 is connected between the first mounting frame 11 and the second mounting frame 12, having two opposite ends mounted with a respective end cap 32 and respectively inserted into the downward receptacle 111 and the upward receptacle 121. A retainer spring 31 is fixed to the inside of the frame bar 3 near the top end, having a raised portion 311 forced into the retaining hole 112 of the downward receptacle 111 of the first mounting frame 11 (see FIG. 3A) to hold the frame bar 3 in the downward receptacle 111 of the first mounting frame 11. When the frame bar 3 is installed in the downward receptacle 111 and the upward receptacle 121, the bottom end of the frame bar 3 is stopped against the stop plate 33 above the spring 34 inside the upward receptacle 121 (see FIG. 3B). A sliding frame 2 is moved along the frame bar 3 between the first mounting frame 11 and the second mounting frame 12. The sliding frame 2 comprises a sleeve 21 slidably sleeved onto the frame bar 3, two round rods 22 raised from the sleeve 21 at two opposite sides, and two locating pins 221 respectively fastened to the round rods 22. Two connectors 41 are respectively pivotably connected to the round rods 22 of the sliding frame 2 to hold two legs 4. Each of the connectors 41 has a transverse coupling tube 42 at the top sleeved onto one round rod 22 of the sliding frame 2. The bottom end of the connector 41 is fixedly secured to one leg 4 by a pin 411. The transverse coupling tube 42 has two symmetrical radial grooves 421 disposed on the inside in contact with the locating pin 221 of the respective round rod 22 (see FIG. 5). The locating pin 221 limits the turning angle of the connector 41 relative to the respective round rod 22 of the sliding frame 2. Two links 5 which are made from resilient metal wire rods are connected between the connectors 41 and the second mounting frame 12. Each of the links 5 has a hooked top end 51 pivotably hooked in a pivot hole 412 on one connector 41, and a hooked bottom end 52 secured to one hook 122 of the second mounting frame 12 and hooked in one retaining hole 531 on a foot plate 53 to hold the foot plate 53 at the bottom side of the second mounting frame 12.

Referring to FIGS. 3, 4, 5, and 6, when the golf bag 1 is placed on the ground and tilted to force the foot plate 53 against the ground, the links 5 are forced to push the legs 4 outwards from the golf bag 1. When the legs 4 are forced outwards from the golf bag 1, the sliding frame 2 is pulled downwards along the frame bar 3, and at the same time, the transverse coupling tubes 42 of the connectors 41 are turned over the locating pins 221. When the locating pins 221 are respectively stopped at one end of the radial groove 421 of the transverse coupling tube 42 of each connector 41, the legs 41 are stopped in an extended position. When the golf bag 1 is moved to the standing position, the links 5 are forced by the hooks 122 of the second mounting frame 12 to pull the connectors 41 and the legs 4 to the collapsed position closely attached to the golf bag 1.

Figure 3A:
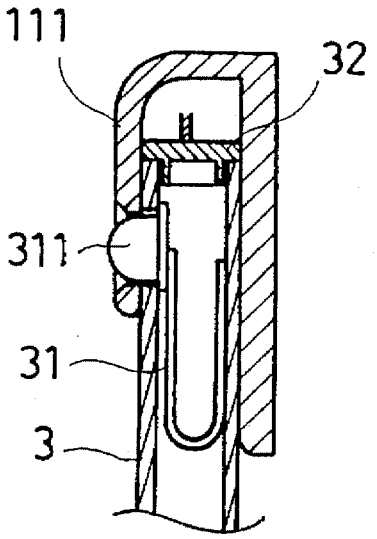
FIG. 3A is a sectional view showing the top end of the frame bar secured to the inside of the downward receptacle of the first mounting frame according to the present invention.
Figure 3:
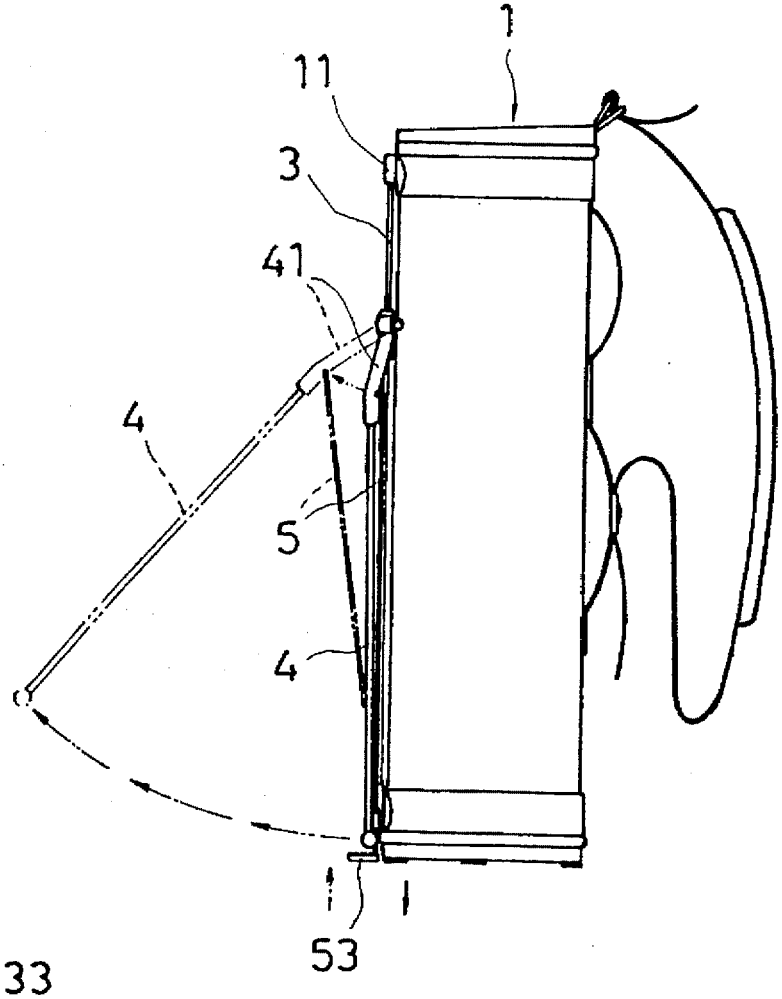
FIG. 3 is a side view of the present invention, showing the legs forced outwards from the golf bag to the extended position.
Figure 3B:
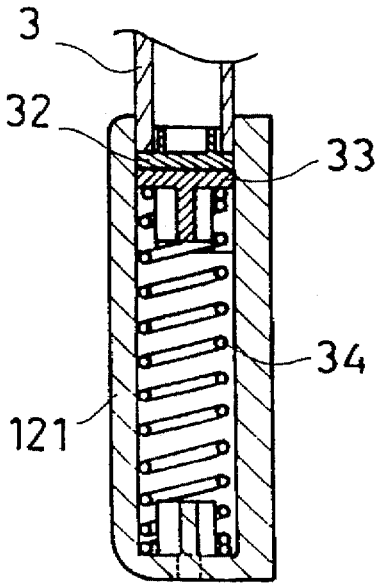
FIG. 3B is a sectional view showing the bottom end of the frame bar supported on the stop plate above the spring in the upward receptacle of the second mounting frame according to the present invention.
Figure 4:
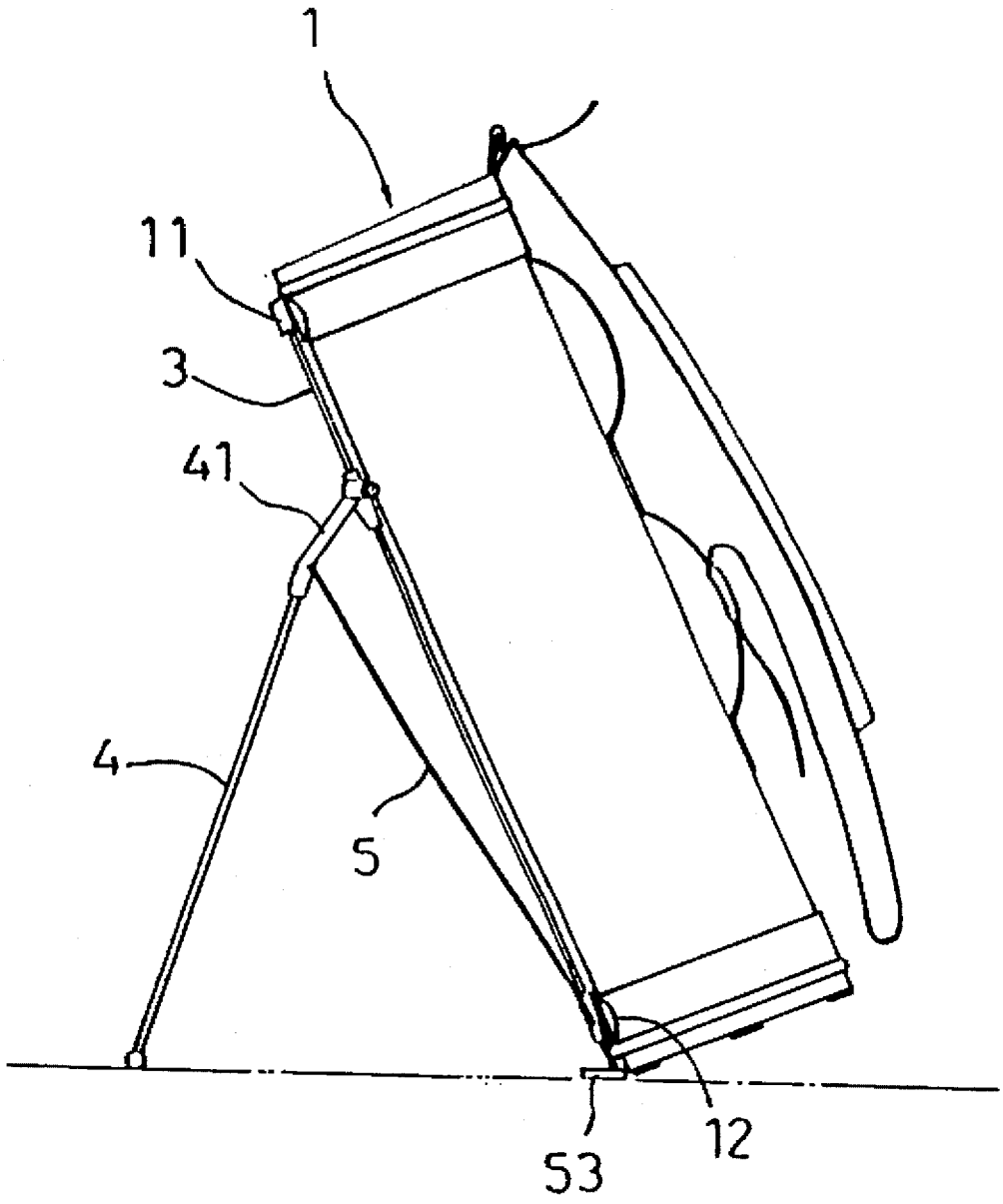
FIG. 4 is another side view of the present invention, showing the golf bag supported on the ground by the legs in a tilted position.

Referring to FIGS. 3A and 3B, the top end of the frame bar 3 is secured to the downward receptacle 111 of the first mounting frame 11 by the retainer spring 31, and the bottom end of the frame bar 3 is supported on the stop plate 33 above the spring 34 inside the upward receptacle 121 of the second mounting frame 12. By forcing the raised portion 311 of the retainer spring 31 inwards from the retaining hole 112 of the downward receptacle 111 of the first mounting frame 11 and pulling the frame bar 3 downwards against the stop plate 33 and the spring 34, the frame bar 3 can be easily disconnected from the first mounting frame 11 and the second mounting frame 12.

It is to be understood that the drawings are designed for purposes of illustration only, and are not intended as a definition of the limits and scope of the invention disclosed.

What the invention claimed is:

1. A foldaway stand comprising:

a first mounting frame fastened to a golf bag on the outside at a higher elevation, said first mounting frame comprising a downward receptacle and a retaining hole at said downward receptacle;

a second mounting frame fastened to said golf bag on the outside at a lower elevation, said second mounting frame comprising an upward receptacle, two hooks raised from said upward receptacle at two opposite sides, a compression spring mounted inside said upward receptacle, and a stop plate supported on said compression spring inside said upward receptacle;

a frame bar having a top end inserted into said downward receptacle, and a bottom end inserted into said upward receptacle and stopped against said stop plate;

a sliding frame moved along said frame bar, said sliding frame comprising a sleeve slidably sleeved onto said frame bar, two round rods raised from said sleeve at two opposite sides, and two locating pins respectively fastened to said round rods;

two legs pivotably connected to the round rods of said sliding frame, and turned within a fixed angle relative to the round rods of said sliding frame between an collapsed position closely attached to said golf bag and an extended position to support said golf bag on the ground in a tilted position;

two connectors respectively connected between said legs and the round rods of said sliding frame, each connector comprising a top transverse coupling tube revolvably sleeved onto one round rod of said sliding frame, two symmetrical radial grooves disposed inside said top transverse coupling tube and acting with the locating pin of the respective round rod to confine the turning angle of said top transverse coupling tube relative to the respective round rod, a bottom end fixedly secured to one leg, and a pivot hole in the middle;

a foot plate attached to said second mounting frame at a bottom side, said foot plate comprising two retaining holes;

two links respectively made from metal rods, each link having a hooked top end pivotably hooked in the pivot hole of one connector, and a hooked bottom end retained to one hook of said second mounting frame and hooked in one retaining hole of said foot plate to hold said foot plate in place; and a retainer spring fixedly secured to the top end of said frame bar, having a raised portion forced into the retaining hole of the downward receptacle of said first mounting frame;

wherein said links are forced by said foot plate to push said legs from the collapsed position to the extended position when said golf bag is tilted to force said foot plate against the ground.

2. The foldaway stand of claim 1 wherein said frame bar can be disconnected from said first mounting frame and said second mounting frame by: forcing the raised portion of said retainer spring inwards from the retaining hole of the downward receptacle of said first mounting frame, and then pulling said frame bar downwards against said stop plate and said compression spring to disengage the top end of said frame bar from the downward receptacle of said first mounting frame.

* * * * *